US011708697B2

(12) United States Patent
Bremer et al.

(10) Patent No.: US 11,708,697 B2
(45) Date of Patent: Jul. 25, 2023

(54) TREAD CAP AND RELATED METHODS OF USE AND MANUFACTURE

(71) Applicant: Zamma Corporation, Inc., Orange, VA (US)

(72) Inventors: William Bremer, Keswick, VA (US); Nathan R. Werkheiser, Salmon, ID (US); Nicholas D. Buser, Charlottesville, VA (US); Russell W. Marks, Palmyra, VA (US)

(73) Assignee: Zamma Corporation, Inc., Orange, VA (US)

( * ) Notice: Subject to any disclaimer, the term of this patent is extended or adjusted under 35 U.S.C. 154(b) by 0 days.

(21) Appl. No.: 17/330,912

(22) Filed: May 26, 2021

(65) Prior Publication Data

US 2022/0381038 A1 Dec. 1, 2022

(51) Int. Cl.
*E04F 11/17* (2006.01)
*E04F 11/16* (2006.01)

(52) U.S. Cl.
CPC ..... *E04F 11/17* (2013.01); *E04F 11/163* (2013.01); *E04F 11/175* (2013.01)

(58) Field of Classification Search
CPC ..... E04F 11/17; E04F 11/163; E04F 11/16; E04F 11/175; E04G 21/30
See application file for complete search history.

(56) References Cited

U.S. PATENT DOCUMENTS 21,799 A * 10/1858 Mayall ..... E04G 21/30
184,013 A * 11/1876 Krickl ..... E04G 21/30 249/207
402,745 A * 5/1889 Knight ..... E04F 11/163 428/43
606,532 A * 6/1898 Furness ..... E04F 11/175 52/179
718,821 A * 1/1903 Cooper ..... E04F 19/063 52/179
1,789,875 A * 1/1931 Loudenslager ..... E04F 15/048 52/179

(Continued)

FOREIGN PATENT DOCUMENTS

DE 3517673 C * 10/1986 ..... E04F 11/1043
DE 4403200 A1 * 8/1995 ..... E04F 11/166

(Continued)

OTHER PUBLICATIONS

Derwent Abstract of DE 9309834 U1 (Year: 1994).*

(Continued)

*Primary Examiner* — Brian D Mattei
*Assistant Examiner* — Charissa Ahmad
(74) *Attorney, Agent, or Firm* — Goodwin Procter LLP

(57) ABSTRACT

A capping apparatus for covering a pre-existing stair structure can include: a tread element; and a trim piece attached to the tread element proximate a longitudinal edge of the tread element. The trim piece includes a back surface defining: a first recess for receiving a thick sub-tread for a first type of pre-existing stair structure; and a second recess for receiving a thin sub-tread for a second type of pre-existing stair structure. Methods of manufacturing and installing the capping apparatus are described.

20 Claims, 16 Drawing Sheets

(56) References Cited

U.S. PATENT DOCUMENTS

| | | | | | |
|---|---|---|---|---|---|
| 2,842,813 | A * | 7/1958 | Van | E04F 11/17 | 52/179 |
| 2,847,732 | A * | 8/1958 | Hyman | E04F 11/17 | 52/179 |
| 2,881,485 | A * | 4/1959 | Hyman | E04F 11/17 | 52/179 |
| 3,801,424 | A * | 4/1974 | Robbins, Jr. | E04F 11/17 | 52/179 |
| 4,322,927 | A | 4/1982 | Scott | | |
| 4,783,939 | A * | 11/1988 | Bergmann | E04F 11/17 | 52/179 |
| 5,531,048 | A * | 7/1996 | Darling | B27D 1/00 | 52/182 |
| 6,067,758 | A | 5/2000 | Zenkner | | |
| 6,397,529 | B1 * | 6/2002 | Grenier | E04F 11/0255 | 52/190 |
| 8,033,063 | B2 * | 10/2011 | Won | E04F 11/16 | 52/188 |
| 8,516,771 | B2 * | 8/2013 | Mang, Sr. | E04F 11/163 | 52/741.2 |
| 8,640,404 | B2 * | 2/2014 | McCool | E04F 11/16 | 52/182 |
| 9,399,874 | B2 | 7/2016 | Spielman | | |
| 9,920,536 | B2 * | 3/2018 | Marhevka, Jr. | E04F 11/175 | 52/179 |
| 2003/0122053 | A1 * | 7/2003 | Sanders | E04F 11/163 | 52/179 |
| 2006/0150539 | A1 * | 7/2006 | Vanhastel | E04F 11/163 | 52/179 |
| 2007/0028534 | A1 * | 2/2007 | Defehr | E04F 11/16 | 52/179 |
| 2008/0295422 | A1 * | 12/2008 | Neuhofer, Jr. | E04F 11/1043 | 52/182 |
| 2009/0277104 | A1 | 11/2009 | McCool | | |
| 2014/0174005 | A1 * | 6/2014 | Richard et al. | E04F 11/175 | 52/179 |
| 2014/0290159 | A1 * | 10/2014 | Mang, Sr. | E04F 11/175 | 52/741.2 |
| 2016/0010339 | A1 * | 1/2016 | Marhevka, Jr. | E04F 11/175 | 52/179 |
| 2016/0312484 | A1 * | 10/2016 | Ruzhin | E04F 11/16 | 52/179 |

FOREIGN PATENT DOCUMENTS

| | | | | |
|---|---|---|---|---|
| DE | 19632301 | A1 * | 9/1997 | E04F 11/163 |
| DE | 20005632 | U1 * | 8/2000 | E04F 11/1045 |
| DE | 20312990 | U1 * | 11/2003 | E04F 11/1043 |
| EP | 1336699 | A2 * | 8/2003 | E04F 11/163 |
| FR | 2458367 | A * | 2/1981 | E04F 11/1043 |
| JP | H08218586 | A * | 8/1996 | E04F 11/166 |
| WO | WO-03046308 | A1 * | 6/2003 | E04F 11/17 |

OTHER PUBLICATIONS

Derwent Abstract of DE 4339317 A1 (Year: 1995).*
Machine translation of DE 19632301 A1 obtained by the European Patent Office (last accessed on Oct. 6, 2022) (Year: 1997).*
Derwent Abstract of DE 4494658 B4 (Year: 2004).*

* cited by examiner

TREAD CAP AND RELATED METHODS OF USE AND MANUFACTURE

TECHNICAL FIELD

In various embodiments, the invention relates to capping structures for covering existing stair treads and related methods of use and manufacture.

BACKGROUND

In certain types of building renovations, there remain various drawbacks and difficulties in the art related to options available for renovating stair cases—specifically stair treads. For example, when renovating an already carpeted house having stairs with laminate flooring, the carpet is removed from the floor and stairs to expose the floor and stair surfaces on which laminate flooring may be installed. With current techniques, to install the laminate on the stairs, existing bull nosing on the stair treads may first need to be removed (e.g., with a saw). This can require substantial labor and skill so that, for example, removal of the bullnose leaves "square" surfaces on the remaining tread and so that the structural integrity of the tread is not compromised.

After removal of the existing bullnose, two or more pieces of laminate floor may need to be installed on the tread and a piece of conventional laminate bull nosing may need to be added to recreate the bull nose of the tread. Such a renovation process requires considerable skill and effort, some of which might be beyond the skill level of typical do-it-yourself home renovators. Further, sub-treads in existing stair structures can have varying thicknesses, which may require manufacture of a variety of different laminate flooring designs.

There is a need for improved apparatus and methods for capping pre-existing stair structures.

SUMMARY OF THE INVENTION

The subject matter described herein relates to a capping apparatus configured to cover pre-existing stair structures having different sub-tread thicknesses. In certain examples, the capping apparatus includes a tread element and a trim piece attached to a front edge of the tread element. A back surface of the trim piece is shaped to define: a first recess for receiving a thick sub-tread for a first type of pre-existing stair structure; and a second recess for receiving a thin sub-tread for a second type of pre-existing stair structure. The first and second recesses in combination can form a P-shaped recess that can receive the thick sub-tread, the thin sub-tread, or other sub-treads having different thicknesses. Advantageously, the single capping apparatus can be used in installations that previously required two or more different types of capping apparatus. For example, the single capping apparatus can cover a variety of sub-tread thickness or geometries that previously required use of multiple types of capping apparatus. Further, a front surface of the capping apparatus can have an aesthetically pleasing design.

In general, in one aspect, the subject matter of this disclosure relates to a capping apparatus for covering a pre-existing stair structure. The apparatus includes: a tread element; and a trim piece attached to the tread element proximate a longitudinal edge of the tread element, wherein the trim piece includes a back surface defining: a first recess for receiving a thick sub-tread for a first type of pre-existing stair structure; and a second recess for receiving a thin sub-tread for a second type of pre-existing stair structure.

In certain examples, the tread element is adapted to cover the thick sub-tread and the thin sub-tread. The back surface can be adapted to be hidden after installation of the apparatus. The trim piece can include a front surface having at least one bullnose portion and at least one concave portion. The trim piece can be attached with adhesive to a groove in the tread element. The thick sub-tread can have a thickness of about 38 mm. The thin sub-tread can have a thickness of about 25 mm. The first recess can be defined by a rectangular notch in the back surface. The second recess can be defined by a concave radius in the back surface. A combination of the first recess and the second recess can be P-shaped. The capping apparatus can include or be formed of a unitary construction.

In another aspect, the subject matter of this disclosure relates to a method of manufacturing a capping apparatus for covering a pre-existing stair structure. The method includes: providing a tread element; machining a groove in a surface of the tread element proximate a longitudinal edge of the tread element; attaching a cap precursor element to the groove; machining the tread element and the cap precursor element to form a front surface including a convex surface and a back surface defining: a first recess for receiving a thick sub-tread for a first type of pre-existing stair structure; and a second recess for receiving a thin sub-tread for a second type of pre-existing stair structure.

In some instances, the groove can extend along an entire width of one side of the longitudinal edge. The cap precursor element can be generally rectangular in cross-section. The cap precursor element can be sized in at least one dimension to have a width approximately equal to a width of the groove and can be sized in at least one other dimension to have a length approximately equal to a length of the groove. Attaching the cap precursor element to the groove can include aligning the widths and lengths of the groove and the cap precursor element.

In another aspect, the subject matter of this disclosure relates to a method of installing a capping apparatus to cover a pre-existing stair structure. The method includes: providing a capping apparatus including: a tread element; and a trim piece attached to the tread element proximate a longitudinal edge of the tread element, wherein the trim piece includes a back surface defining: a first recess for receiving a thick sub-tread for a first type of pre-existing stair structure; and a second recess for receiving a thin sub-tread for a second type of pre-existing stair structure; and attaching the capping apparatus to either the first type of pre-existing stair structure or the second type of pre-existing stair structure.

In various implementations, attaching the capping apparatus can include securing the capping apparatus using at least one of an adhesive or a mechanical fastener. The method can include attaching a riser board to the first type of pre-existing stair structure or the second type of pre-existing stair structure. The method can include cutting off an outer edge of the thin sub-tread or the thick sub-tread prior to attaching the capping apparatus.

These and other objects, along with advantages and features of embodiments of the present invention herein disclosed, will become more apparent through reference to the following description, the figures, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
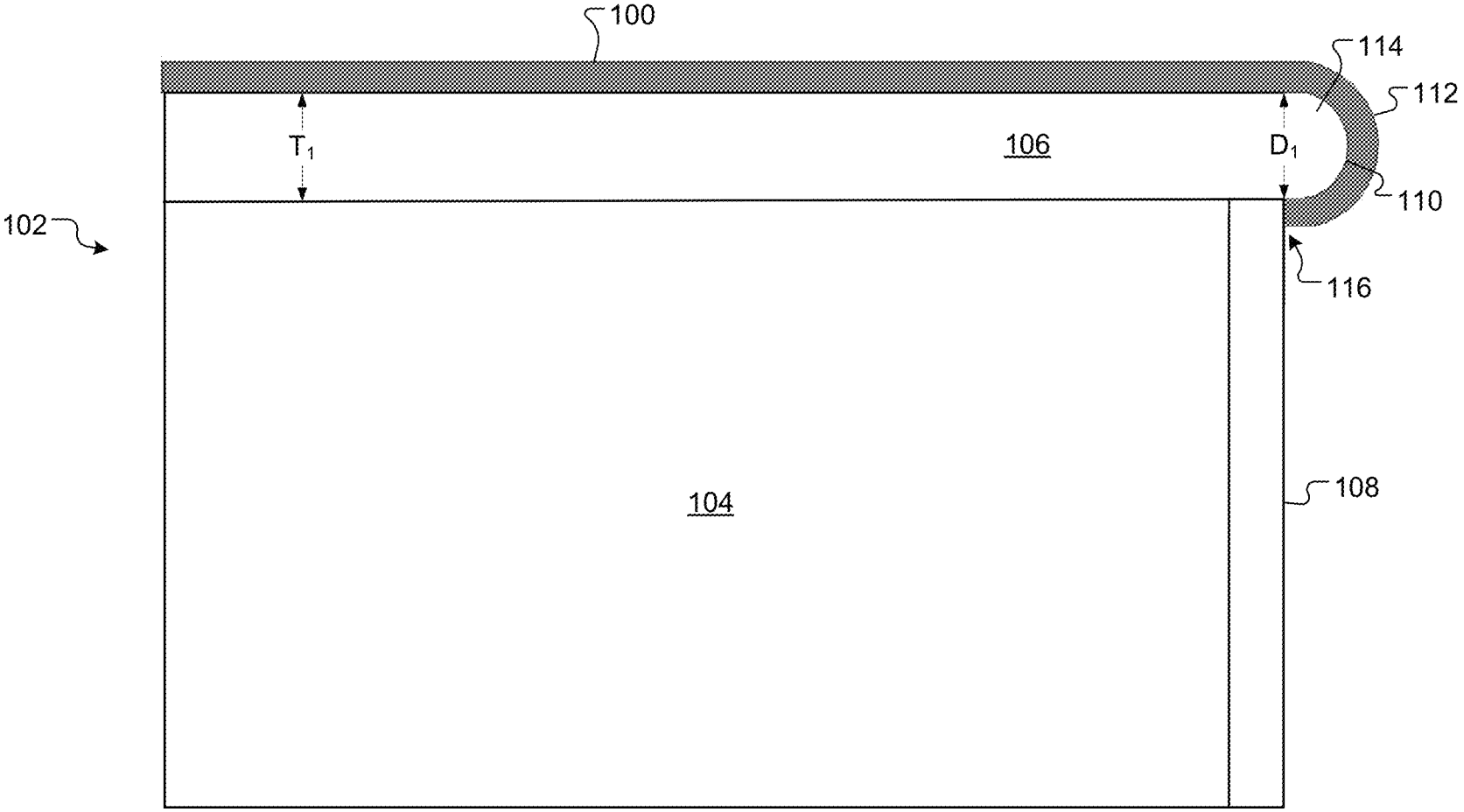
FIG. 1 is a cross-sectional, side view of a capping apparatus installed on a first type of pre-existing stair structure, in accordance with certain embodiments.

FIG. 1 illustrates a capping apparatus 100 installed on a first type of pre-existing stair structure 102 having a stair support 104, a sub-tread 106, and a riser board 108. The sub-tread 106 is disposed over the stair support 104 and has a thickness $T_1$. The riser board 108 is attached to a front portion of the stair support 104 and forms a front face of the first type of pre-existing stair structure 102. A front edge 110 of the sub-tread 106 has a rounded or bullnose shape that is covered by a rounded portion 112 of the capping apparatus 100. The rounded portion 112 defines a rounded inner cavity 114 that receives the front edge 110 of the sub-tread 106. A height $D_1$ (e.g., an inner diameter) of the inner cavity 114 of the rounded portion 112 is configured to be equal to the thickness $T_1$ or slightly larger than the thickness $T_1$ (e.g., by about 1-3 mm), to provide a desired clearance. In a typical example, the height $D_1$ and the thickness $T_1$ can be about 25 mm (about 1 inch). A terminal end 116 of the rounded portion 112 is in contact with or in close proximity to (e.g., within about 1-3 mm) the riser board 108, such that the sub-tread 106 can be invisible and/or completely covered by the capping apparatus 100.

Figure 2:
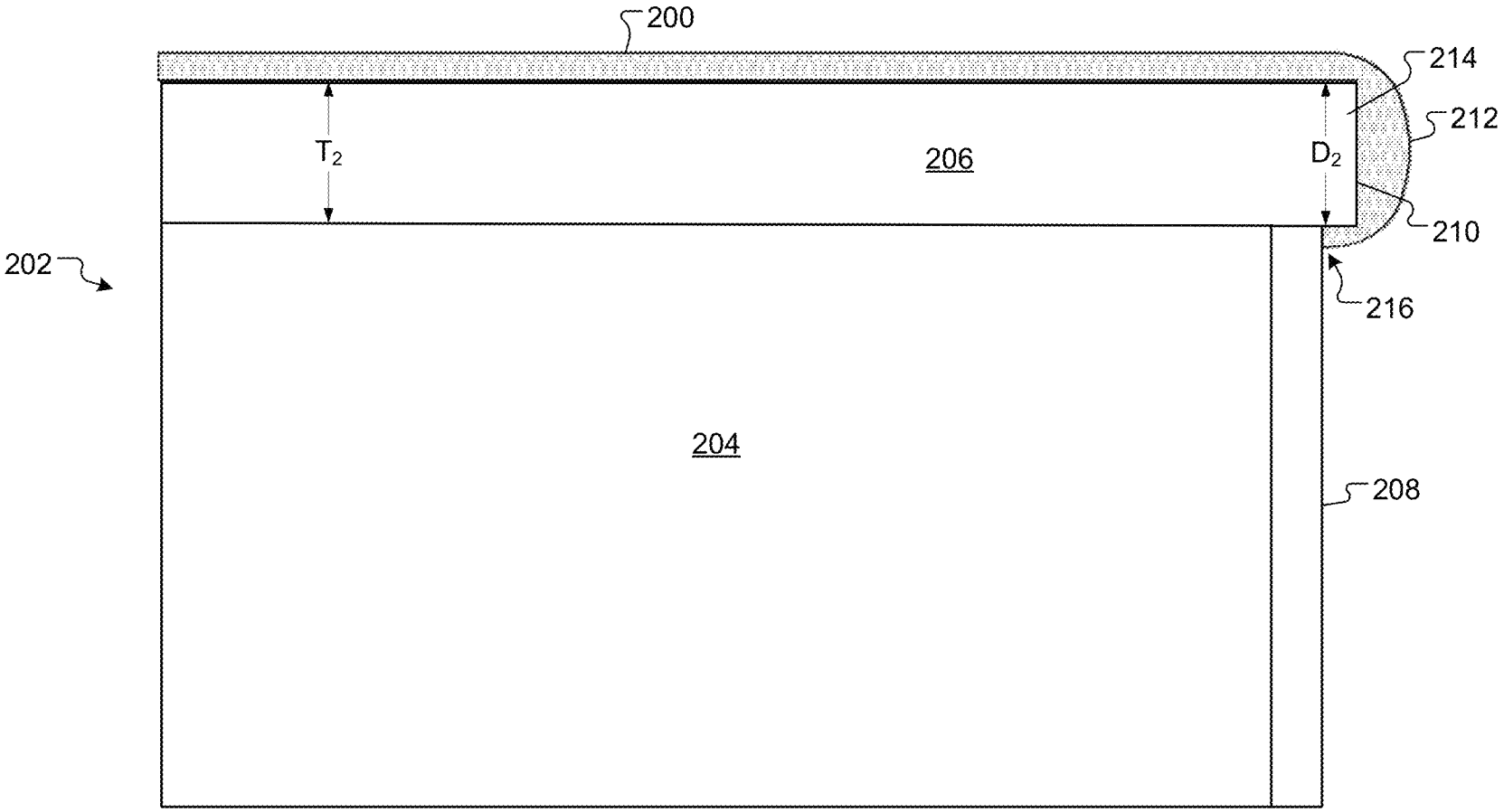
FIG. 2 is a cross-sectional, side view of a capping apparatus installed on a second type of pre-existing stair structure, in accordance with certain embodiments.

FIG. 2 illustrates a different capping apparatus 200 installed on a second type of pre-existing stair structure 202 having a stair support 204, a sub-tread 206, and a riser board 208. The sub-tread 206 is disposed over the stair support 204 and has a thickness $T_2$. The riser board 208 is attached to a front portion of the stair support 204 and forms a front face of the second type of pre-existing stair structure 202. A front edge 210 of the sub-tread 206 has a shape that is rectangular in cross-section and is covered by a rounded portion 212 of the capping apparatus 200. The rounded portion 212 defines an inner cavity 214 that receives the front edge 210 of the sub-tread 206. A height $D_2$ of the inner cavity 214 of the rounded portion 212 is configured to be equal to the thickness $T_2$ or slightly larger than the thickness $T_2$ (e.g., by about 1-3 mm), to provide a desired clearance. In a typical example, the height $D_2$ and the thickness $T_2$ can be about 38 mm (about 1.5 inches) or can be as high as about 42 mm (about 1.65 inches). A terminal end 216 of the rounded portion 212 is in contact with or in close proximity to (e.g., within about 1-3 mm) the riser board 208, such that the sub-tread 206 can be invisible and/or completely covered by the capping apparatus 200.

In general, due to the different sub-tread thicknesses $T_1$ and $T_2$ and or different geometries of the front edges 110 and 210, the capping apparatus 100 is configured for use with the stair structure 102 and the capping apparatus 200 is configured for use with the stair structure 202. For example, because the height $D_1$ can be less than the thickness $T_2$, the inner cavity 114 of the capping apparatus 100 may be too small to receive the front edge 210 of the sub-tread 206. Likewise, while the height $D_2$ is greater than the thickness $T_1$, such that the inner cavity 214 of the capping apparatus 200 may be large enough to receive the front edge 110 of the sub-tread 106, the rounded portion 212 of capping apparatus 200 lacks a traditional, low-profile design of capping apparatus 100 and/or a conventional bullnose shape, which may make the capping apparatus 200 less appealing to consumers. Additionally or alternatively, installation of the capping apparatus 200 may require a bullnose portion (e.g., the front edge 110) of a sub-tread to be sawed off (e.g., to form a rectangular cross-section), which can add another step to the installation process. Consequently, it is desirable to provide a capping apparatus that is able to accommodate both types of pre-existing stair structures 102 and 202, while being easy to install (e.g., no requirement to saw off a bullnose portion of a sub-tread) and having an aesthetically appealing design.

Figure 3:
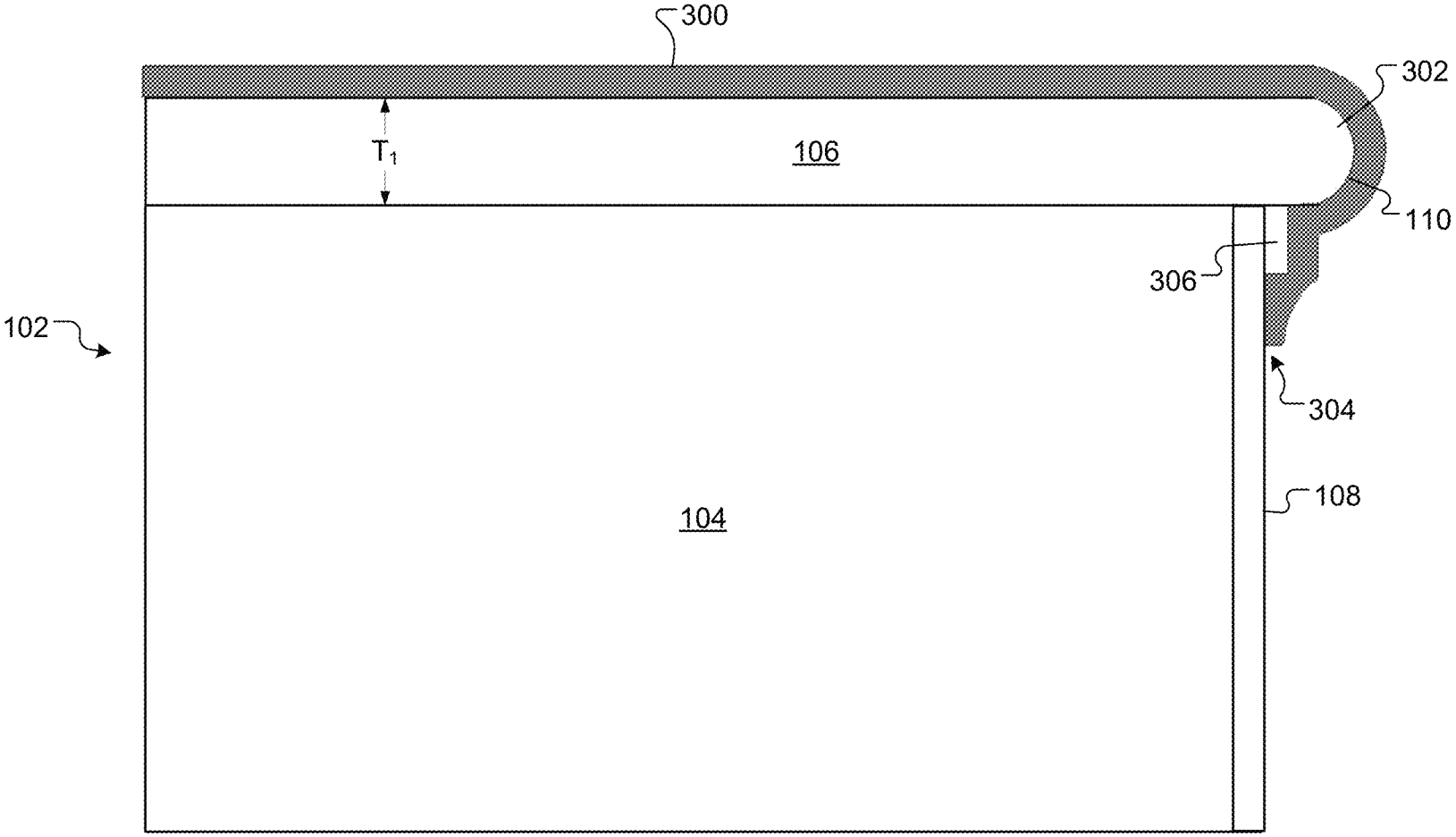
FIG. 3 is a cross-sectional, side view of a capping apparatus installed on the first type of pre-existing stair structure, in accordance with certain embodiments.
Figure 4:
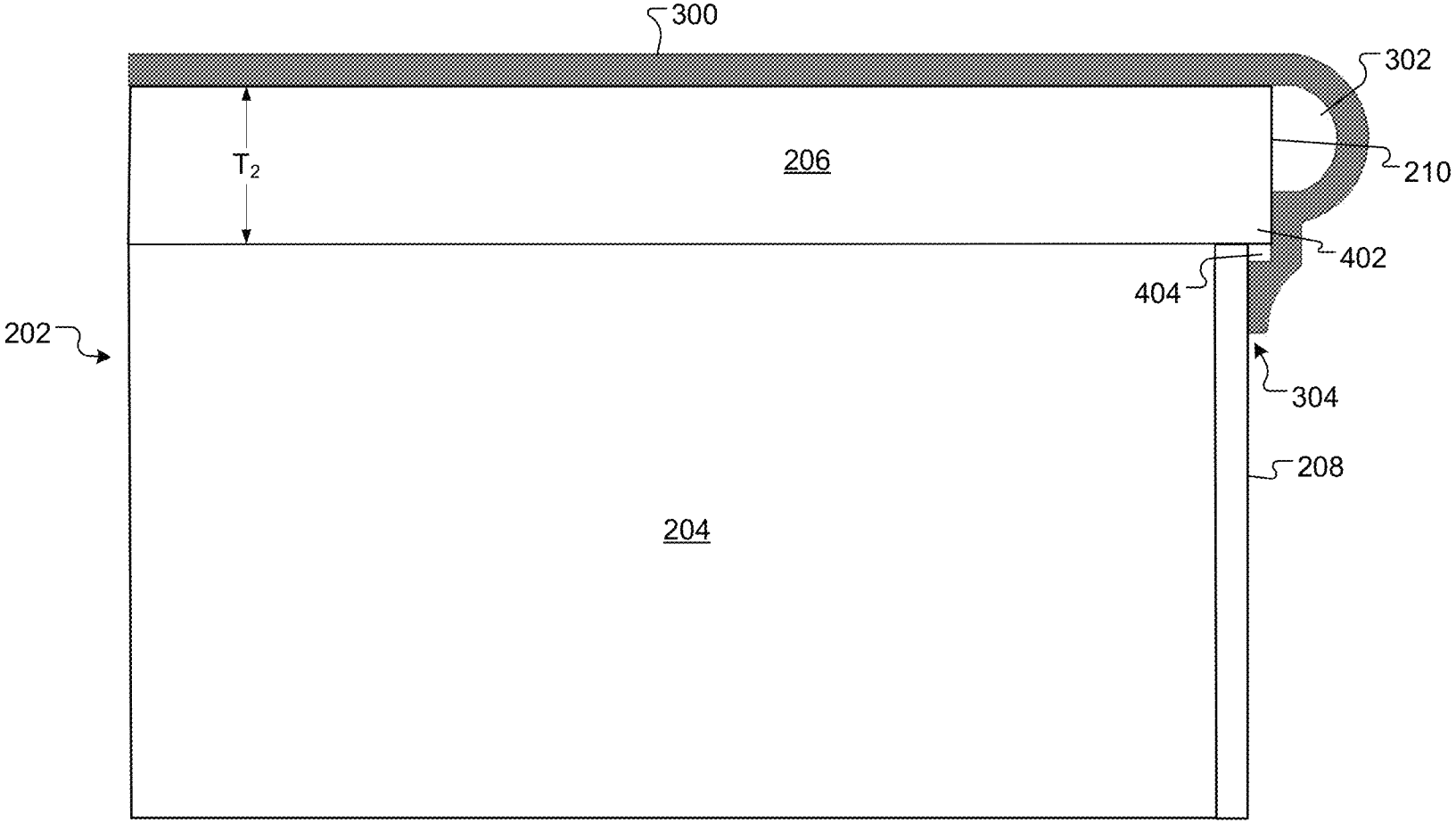
FIG. 4 is a cross-sectional, side view of the capping apparatus of FIG. 3 installed on the second type of pre-existing stair structure, in accordance with certain embodiments.

Advantageously, FIGS. 3 and 4 show a capping apparatus 300 that is configured for use with a range of sub-tread thicknesses and shapes, including both types of pre-existing stair structures 102 and 202. FIG. 3 depicts the capping apparatus 300 installed on the first type of pre-existing stair structure 102. The capping apparatus 300 defines an inner cavity or recess 302 for receiving the front edge 110 of the sub-tread 106. A terminal end 304 of the capping apparatus 300 is in contact with or in close proximity to (e.g., within about 1-3 mm) the riser board 108, such that the sub-tread 106 can be invisible and/or completely covered by the capping apparatus 300. A thickness of the riser board 108 can be chosen to provide a desired fit or clearance with the terminal end 304 of the capping apparatus 300. An interior space 306 between the capping apparatus 300, the sub-tread 106, and the riser board 108 can be occupied by air, wood, foam, and/or other desired material.

Likewise, FIG. 4 depicts the capping apparatus 300 installed on the second type of pre-existing stair structure 202. The capping apparatus 300 defines an inner cavity or recess 402 for receiving the front edge 210 of the sub-tread 206. The terminal end 304 of the capping apparatus 300 is in contact with or in close proximity to (e.g., within about 1-3 mm) the riser board 208, such that the sub-tread 206 can be invisible and/or completely covered by the capping apparatus 300. A thickness of the riser board 208 can be chosen to provide a desired fit or clearance with the terminal end 304 of the capping apparatus 300. The inner recess 302 in this example can be unoccupied by the sub-tread 206 and/or can be occupied by air, wood, foam, and/or other desired material. Additionally or alternatively, depending on the thickness T2 of the sub-tread 206, a portion 404 of the inner recess 402 may be unoccupied by the sub-tread 206 and/or can be occupied by air, wood, foam, and/or other desired material. The inner recess 402 can be configured to accommodate a range of possible sub-tread thicknesses. In some embodiments, the sub-tread 206 may occupy an entirety of the inner recess 402, such that the unoccupied portion 404 does not exist.

Figure 5:
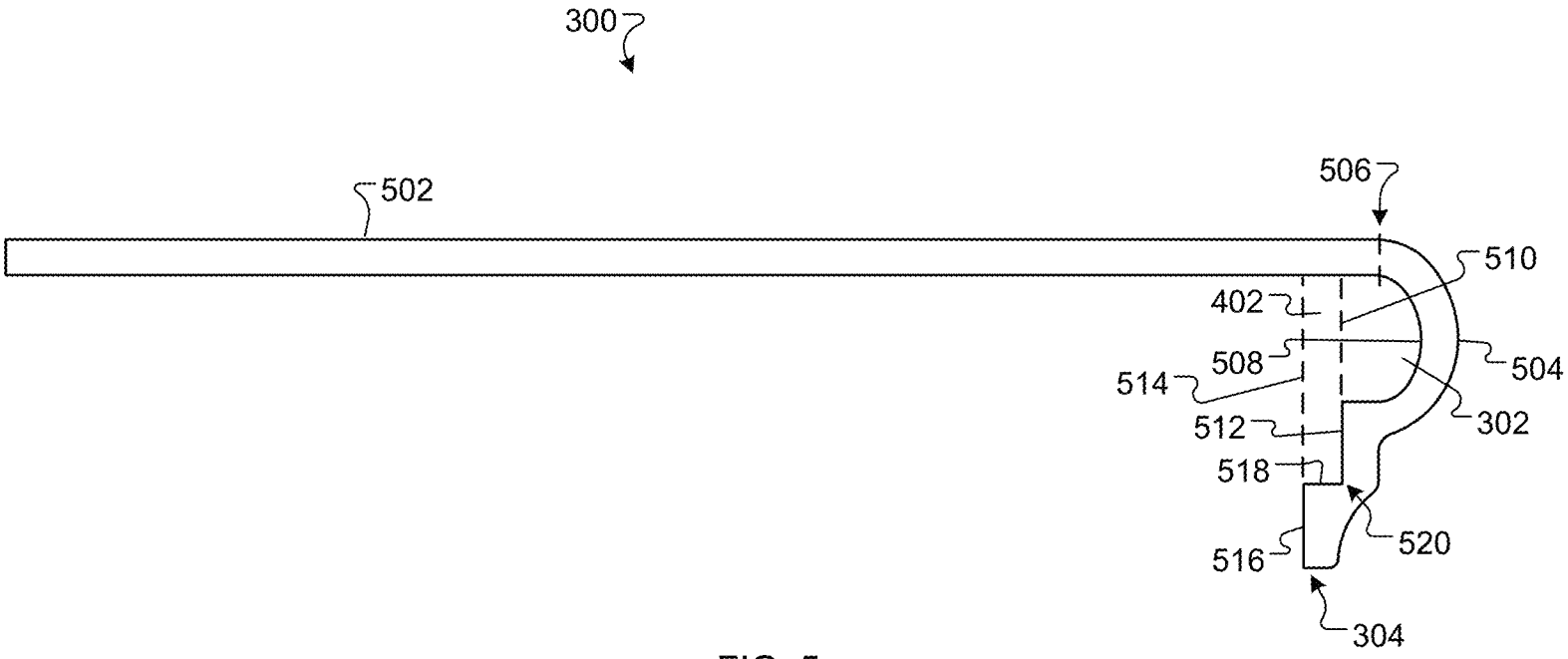
FIG. 5 is a side view of the capping apparatus of FIG. 3, in accordance with certain embodiments.

Referring to FIG. 5, the capping apparatus 300 includes a tread element 502 and a trim piece 504 attached to the tread element at or along a longitudinal edge 506 (e.g., a front edge) of the tread element 502. In some examples, the capping apparatus 300, including the tread element 502 and the trim piece 504, can be of unitary construction (e.g., a single material). Alternatively or additionally, the capping apparatus 300 can be formed from two separate components that are bonded together, as described herein, with one component forming the tread element 502 and the other component forming the trim piece 504. In some examples, the tread element 502 or the trim piece 504 can be formed from multiple components. The tread element 502 can be planar or substantially planar (e.g., visually planar).

A back surface 508 of the trim piece 504 defines the inner recess 302 and the inner recess 402. A boundary 510 between the inner recess 302 and the inner recess 402 is defined by a stepped portion 512 of the back surface 508. An opposite boundary 514 for the inner recess 402 is defined a flat face 516 at the terminal end 304 of the capping apparatus 300. The stepped portion 512 and the flat face 516 can be parallel or substantially parallel (e.g., visually parallel) to one another. Additionally or alternatively, the stepped portion 512 and/or the flat face 516 can be perpendicular or substantially perpendicular (e.g., visually perpendicular) to a surface of the tread element 502. In some examples, the stepped portion 512 and an adjacent face 518 are perpendicular or substantially perpendicular to one another and form a rectangular notch 520.

In the depicted example, the inner recess 302 can have a bullnose profile or cross-section, which can be or include a concave radius. The inner recess 402 can be rectangular in cross-section, with the boundary 510 and the boundary 514 being parallel to one another. Collectively, the inner recess 302 and the inner recess 402 can have a cross-section that is shaped like the letter P or P-shaped.

Figure 6:
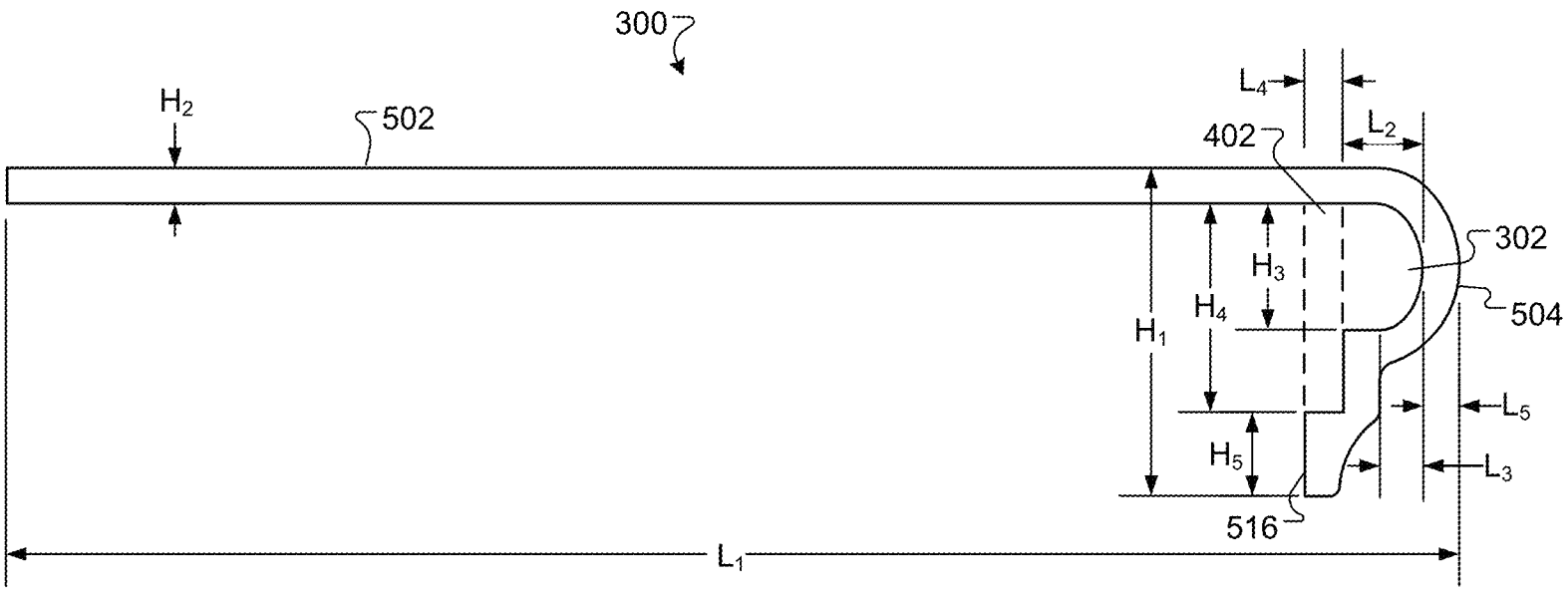
FIG. 6 is a side view of the capping apparatus of FIG. 3, in accordance with certain embodiments.

FIG. 6 illustrates various dimensions for the capping apparatus 300, according to certain embodiments. The dimensions include: a total height $H_1$ of the capping apparatus 300, a thickness $H_2$ of the tread element 502, a height $H_3$ of the inner recess 302, a height $H_4$ of the inner recess 402, a height $H_5$ of the flat face 516, a total length $L_1$ of the capping apparatus 300, a length $L_2$ of the inner recess 302, a length $L_3$ of a curved portion of the inner recess 302, a length $L_4$ of the inner recess 402, and a thickness $L_5$ of the trim piece 504. Example low, high, and typical values for these dimensions and other parameters for the capping apparatus 300 are provided in Table 1. Each listed value or value within a listed range can be a minimum, maximum, or average value. Various embodiments include any parameter value (e.g., integer or decimal value) within the cited ranges. For example, the total height $H_1$ can be 63, 64, 65, 66, or 67 mm. Likewise, the total length $L_1$ can be 307, 308, . . . , 311, or 312 mm. Express support and written description of these parameter values for each parameter are hereby represented.

TABLE 1

Exemplary parameters for the capping apparatus.

| Parameter | Low | Typical | High |
|---|---|---|---|
| Total Height $H_1$ of Capping Apparatus (mm) | 63 | 65 | 67 |
| Thickness $H_2$ of Tread Element (mm) | 6 | 7-8 | 9 |
| Height $H_3$ of Inner Recess (mm) | 25 | 27 | 29 |
| Height $H_4$ of Inner Recess (mm) | 39 | 42-43 | 46 |
| Height $H_5$ of Flat Face (mm) | 13 | 16 | 19 |
| Total Length $L_1$ of Capping Apparatus (mm) | 307 | 309-310 | 312 |
| Length $L_2$ of Inner Recess (mm) | 11 | 15 | 19 |
| Length $L_3$ of Curved Portion of Inner Recess (mm) | 3 | 6-7 | 10 |
| Length $L_4$ of Inner Recess (mm) | 3 | 6-7 | 10 |
| Thickness $L_5$ of Trim Piece (mm) | 6 | 7-8 | 9 |
| Width W of Capping Apparatus (m) | 0.75 | 1.1-2.45 | 2.75 |
| Thickness $T_1$ of Sub-Tread (mm) | 23 | 26 | 29 |
| Thickness $T_2$ of Sub-Tread (mm) | 28 | 31-39 | 42 |

Figure 7:
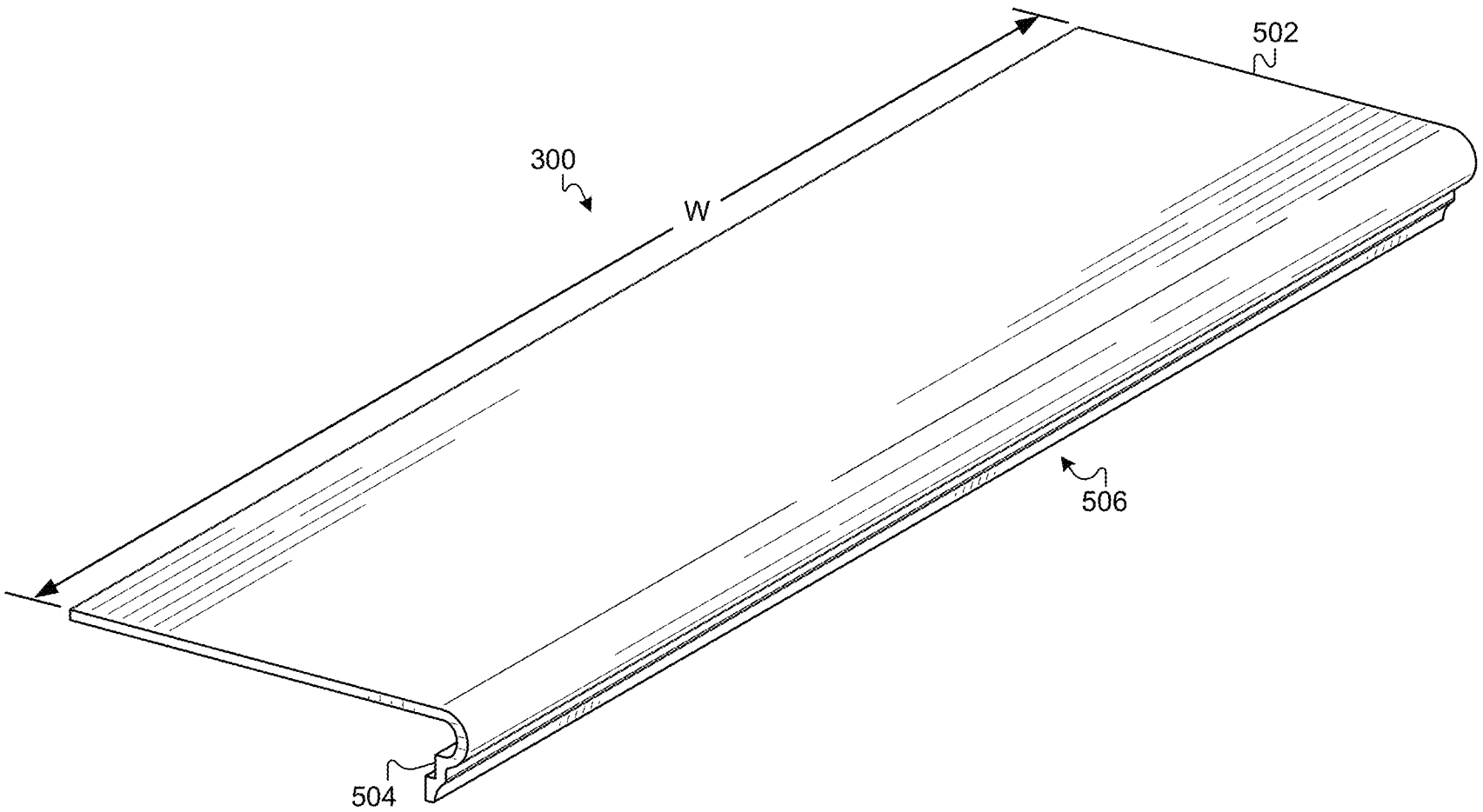
FIG. 7 is a front perspective view of the capping apparatus of FIG. 3, in accordance with certain embodiments.
Figure 8:
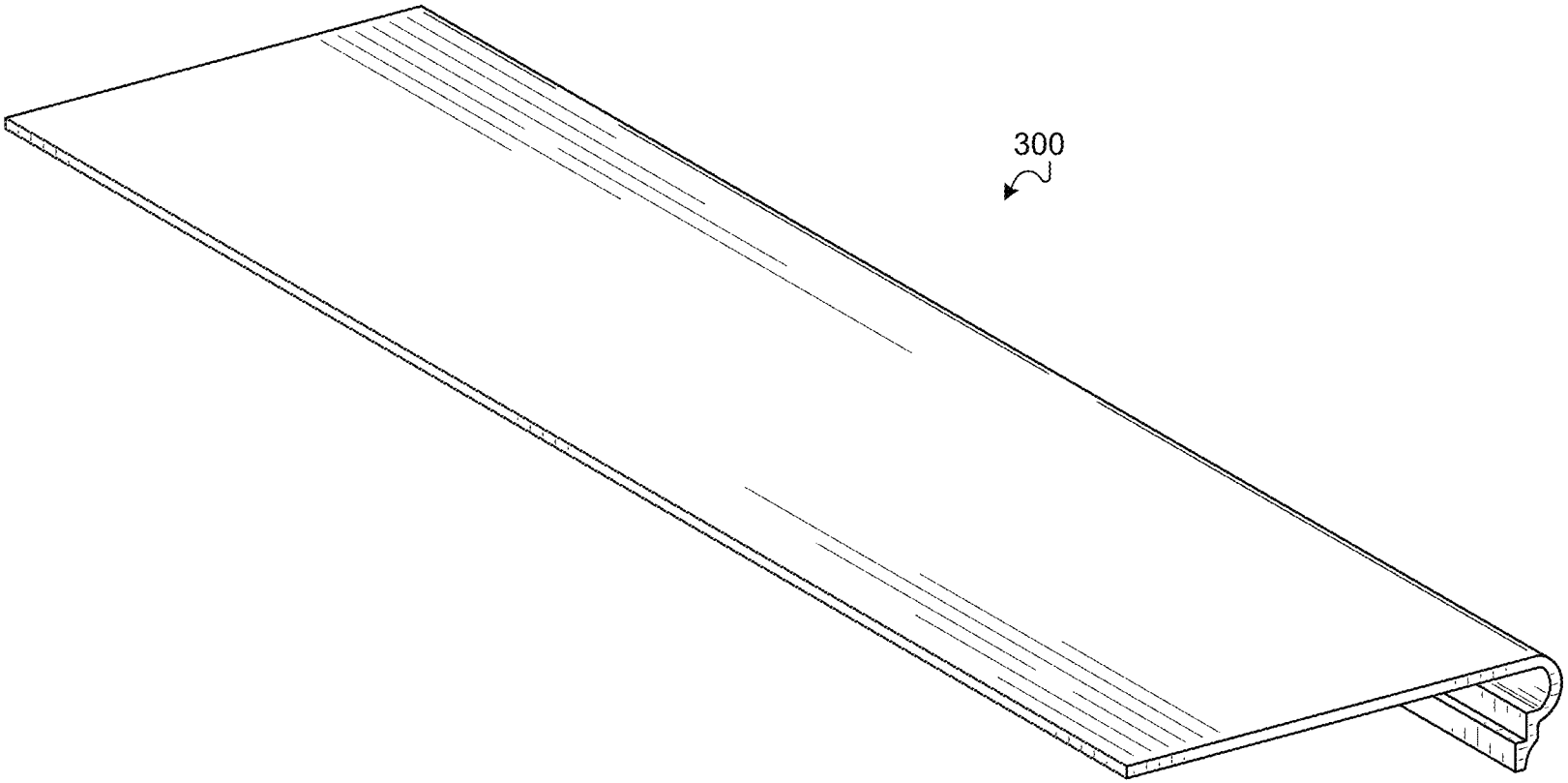
FIG. 8 is a rear perspective view of the capping apparatus of FIG. 3, in accordance with certain embodiments.
Figure 9:
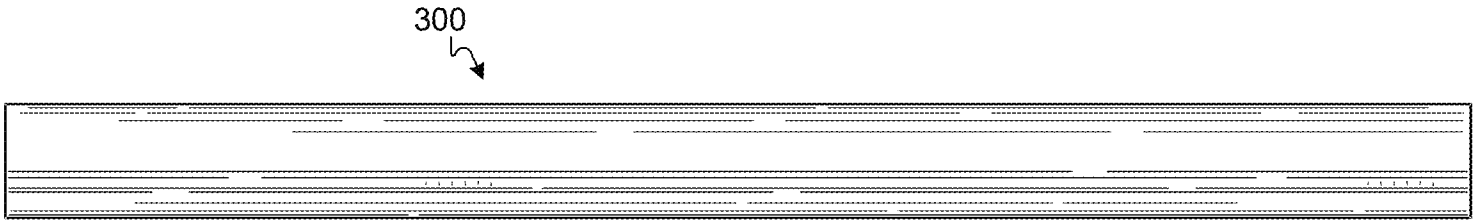
FIG. 9 is a front view of the capping apparatus of FIG. 3, in accordance with certain embodiments.
Figure 10:
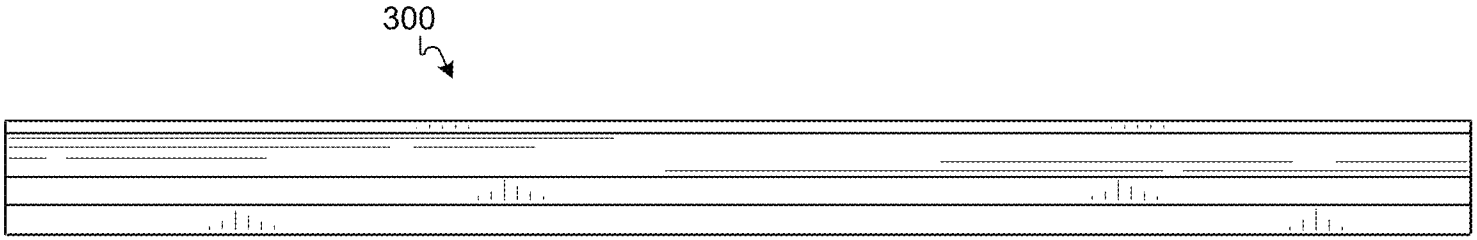
FIG. 10 is a back view of the capping apparatus of FIG. 3, in accordance with certain embodiments.
Figure 11:
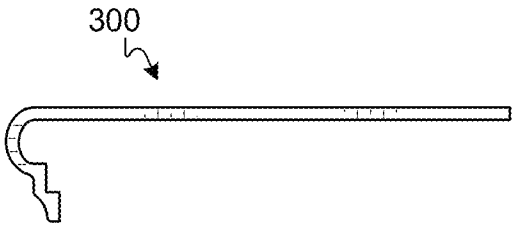
FIG. 11 is a left side view of the capping apparatus of FIG. 3, in accordance with certain embodiments.
Figure 12:
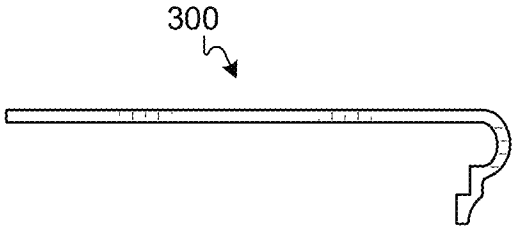
FIG. 12 is a right side view of the capping apparatus of FIG. 3, in accordance with certain embodiments.
Figure 13:
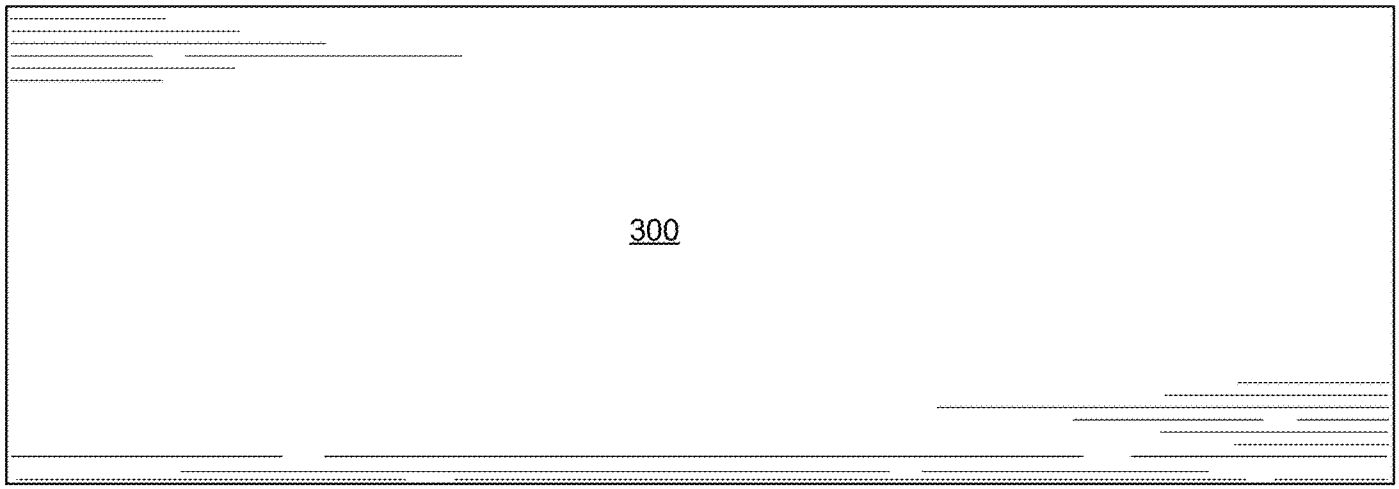
FIG. 13 is a top view of the capping apparatus of FIG. 3, in accordance with certain embodiments.
Figure 14:
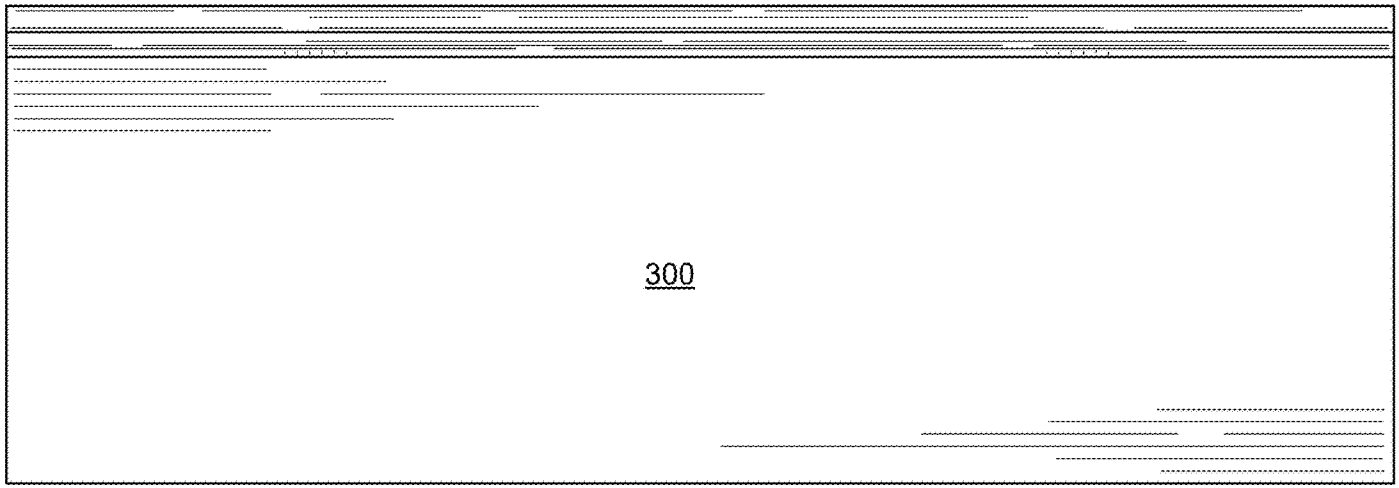
FIG. 14 is a bottom view of the capping apparatus of FIG. 3, in accordance with certain embodiments.

FIGS. 7-14 include a variety of additional views of the capping apparatus 300. FIG. 7 includes a perspective view showing the tread element 502, the trim piece 504, and the longitudinal edge 506 of the capping apparatus 300. The longitudinal edge 506 extends along a width W of the capping apparatus 300. The depicted embodiment indicates the capping apparatus 300 can be made of a single, continuous material (e.g., unitary construction). It is understood, however, that the capping apparatus 300 can be constructed of multiple components and/or materials. In some examples, the capping apparatus 300 or portion thereof is made of or includes a high density fiberboard ("HDF"), a medium density fiberboard ("MDF"), a moisture resistant fiberboard ("MRF"), wood (e.g., a wood veneer), vinyl (e.g., PVC), other polymeric materials, coating materials, laminate materials, veneers, or any combination thereof.

Figure 15:
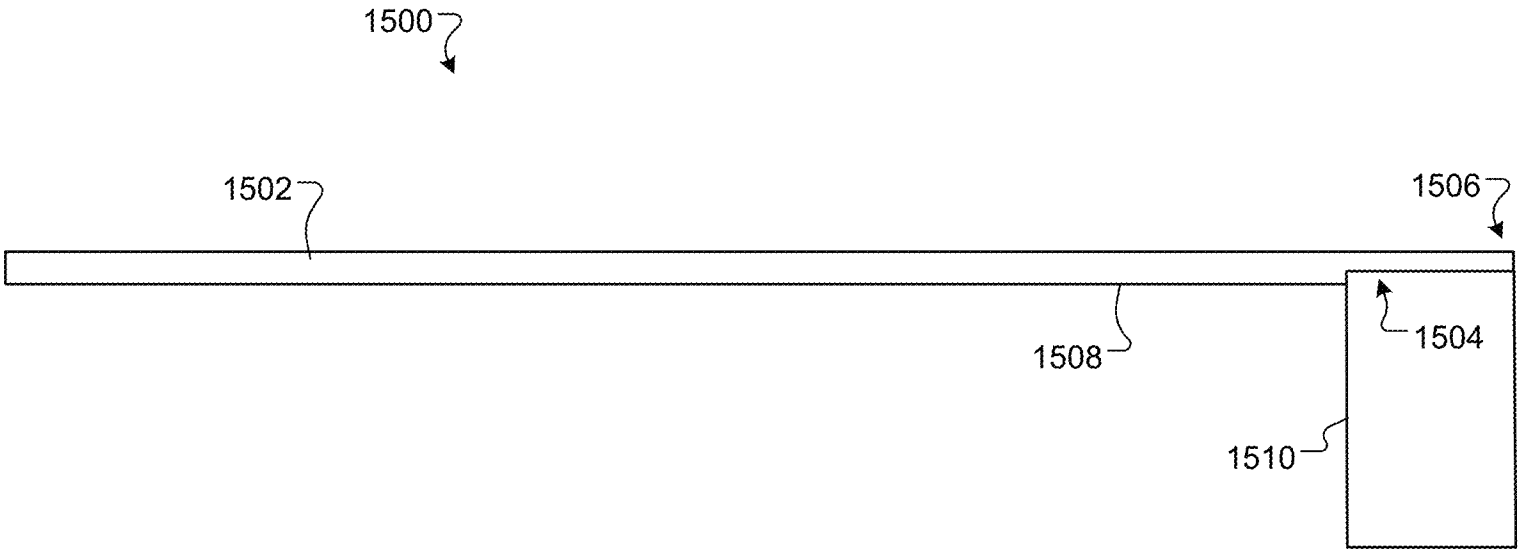
FIG. 15 is a side view of a capping apparatus during an initial stage of a manufacturing process, in accordance with certain embodiments of the invention.
Figure 16:
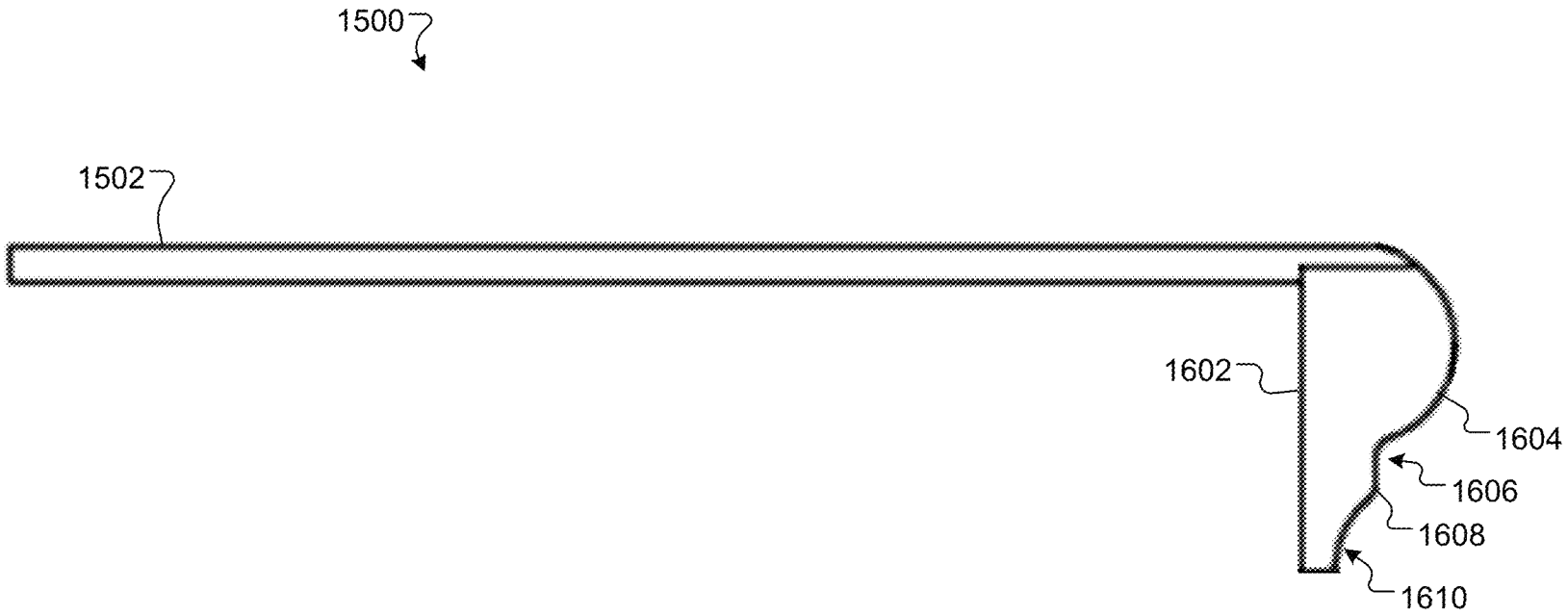
FIG. 16 is a side view of the capping apparatus of FIG. 15 during an intermediate stage of the manufacturing process, in accordance with certain embodiments.
Figure 17:
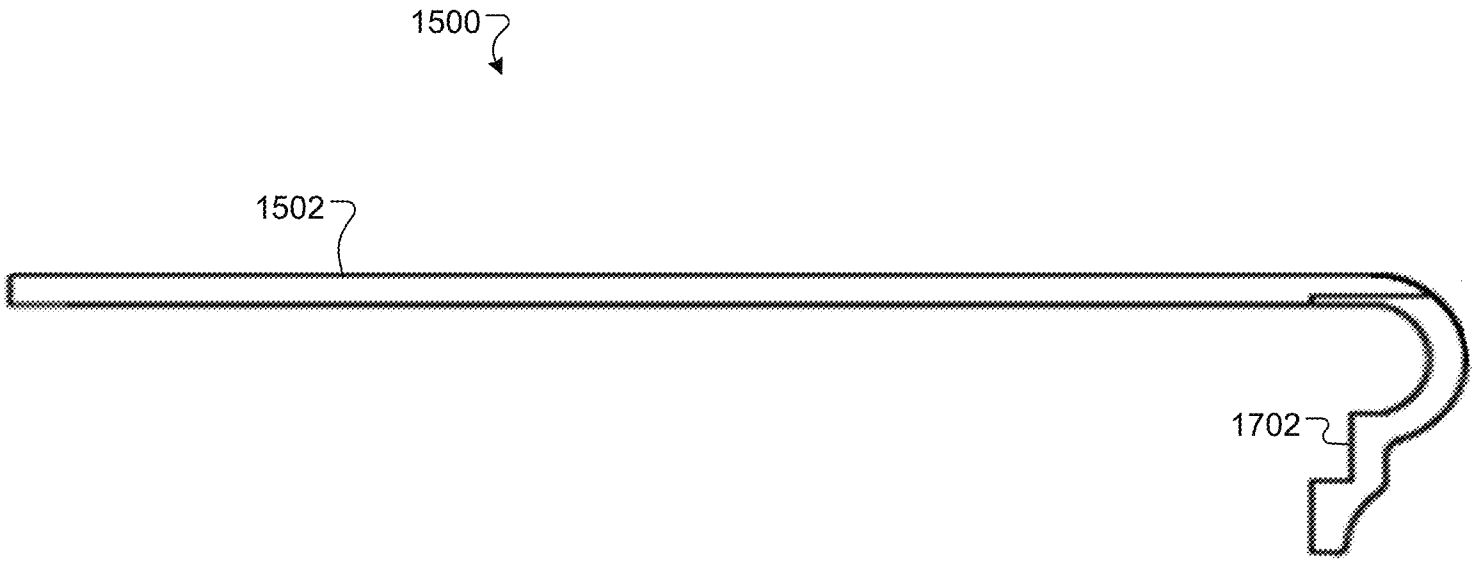
FIG. 17 is a side view of the capping apparatus of FIG. 15 during a final stage of the manufacturing process, in accordance with certain embodiments.

FIGS. 15-17 illustrate a sequence of steps that can be performed to manufacture a capping apparatus 1500, which may be the same as the capping apparatus 300, in accordance with certain embodiments. Referring to FIG. 15, during an initial manufacturing step, a tread element 1502 can be obtained, and a groove or recess 1504 can be formed (e.g., machined, milled, and/or molded) in a surface of the tread element 1502, proximate a longitudinal edge 1506 of the tread element 1502. The groove 1504 can extend along an entire width of a bottom side 1508 of the longitudinal edge 1506. The groove 1504 can have a depth of about ⅛, about ¼, or about ½ of a thickness of the tread element 1502. A trim precursor element 1510 can be placed into the groove 1504 and bonded to the tread element 1502 (e.g., using an adhesive and/or mechanical fasteners). The trim precursor element 1510 can be rectangular in cross-section, as shown, and/or can extend along the entire width of the longitudinal edge 1506 of the tread element 1502.

FIG. 16 depicts the capping apparatus 1500 during an intermediate stage of the manufacturing process. In the depicted example, a front or outer surface of the original trim precursor element 1510 has been machined to form an intermediate trim element 1602. The outer surface of the intermediate trim element 1602 includes a rounded, convex, or bullnose portion 1604, an upper concave portion 1606, a small rib or protrusion 1608, and a bottom concave portion 1610. In general, the outer surface of the intermediate trim element 1602 can include one or more decorative features.

FIG. 17 depicts the capping apparatus 1500 after a final stage of the manufacturing process. In the depicted example, a back or inner surface of the intermediate trim element 1602 has been further modified to form a trim piece 1702, which can be the same as the trim piece 504. The modifications to the inner surface can be performed in a machining process, which can involve, for example, use of a mill, a router, and/or a CNC machine.

Referring again to FIG. 5, in other examples, the capping apparatus 300 can be manufactured in a molding or extrusion process. For example, materials for the capping apparatus 300 can be melted, extruded, and cooled to form the capping apparatus 300. Additionally or alternatively, materials for the capping apparatus 300 can be melted, added to a mold, and cooled to form the capping apparatus 300. In some examples, the capping apparatus 300 can be formed from a sheet of material that is heated and/or pressed into a desired shape (e.g., thermoforming) for the capping apparatus 300.

In some examples, a laminate structure (e.g., a wear layer or a decorative layer) can be applied and bonded to one or more portions of the tread element 502 (e.g., a top surface) and/or the trim piece 504 (e.g., using a profile wrapper). The laminate structure can be or include, for example, a laminate sheet, such as a wear resistant, decorative laminate of suitable thickness. In certain implementations, the laminate structure can be or include a thermosetting laminate, a continuous pressure laminate, a resin-impregnated fabric or paper, a wood veneer, a coating, a paint, a printed pattern (e.g., a wood-grain pattern), or any combination thereof. The laminate structure can provide structural strength or rigidity, wear resistance, and/or decorative properties (e.g., the appearance of hard wood, bamboo, etc.). Methods of manufacturing tread caps are described in U.S. Pat. No. 9,399,874, issued Jul. 26, 2016, the entire disclosure of which is hereby incorporated by reference.

Figure 18:
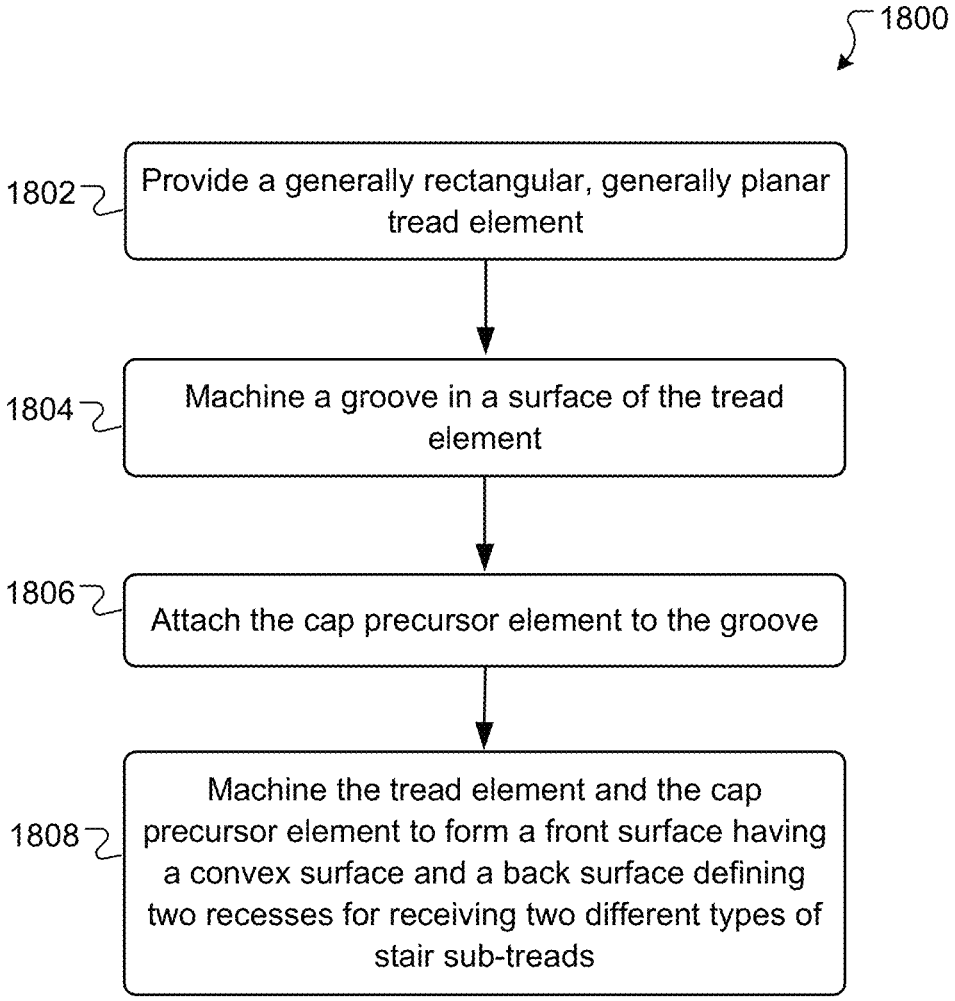
FIG. 18 is a flowchart of a method of manufacturing a capping apparatus, in accordance with certain embodiments.

FIG. 18 includes a flowchart of a method 1800 of manufacturing a capping apparatus, according to certain examples. A tread element is provided (step 1802) and a groove is machined (step 1804) in a surface of the tread element, proximate a longitudinal or front edge of the tread element. The groove can extend an entire length of one side of the tread element (e.g., along an entire front edge or width). A cap precursor element is attached (step 1806) to the groove. The cap precursor element can be sized in at least one dimension to have a width approximately equal to a width of the groove and sized in at least one other dimension to have a length approximately equal to a length of the groove. The tread element and/or the cap precursor element are machined (step 1808) to form a front surface having a convex surface and a back surface defining: a first recess for receiving a thick sub-tread for a first type of pre-existing stair structure; and a second recess for receiving a thin sub-tread for a second type of pre-existing stair structure.

Figure 19:
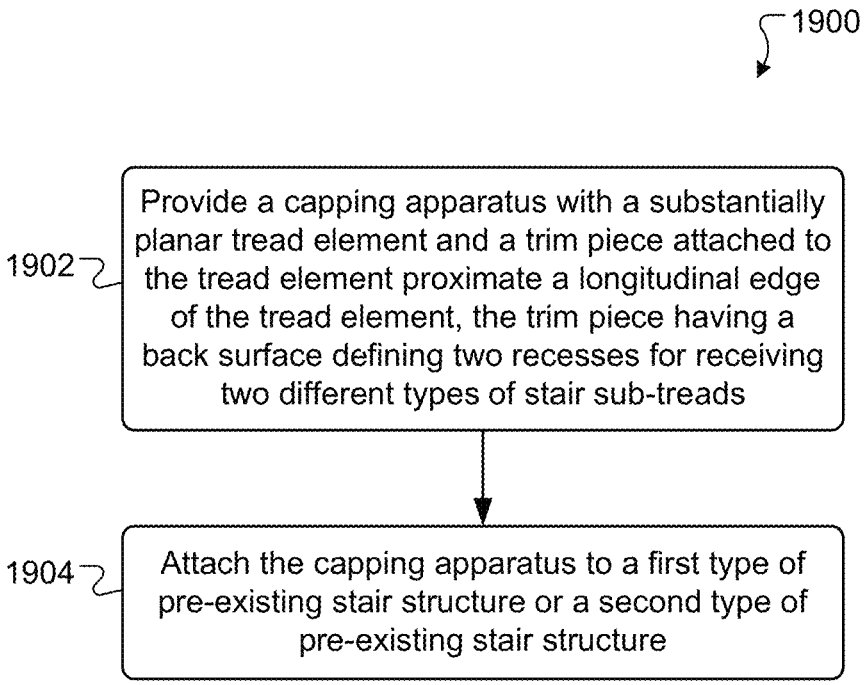
FIG. 19 is a flowchart of a method of installing a capping apparatus, in accordance with certain embodiments.

FIG. 19 includes a flowchart of a method 1900 of installing a capping apparatus, in accordance with certain examples. A capping apparatus is provided (step 1902) that includes: a tread element; and a trim piece attached to the tread element proximate a longitudinal edge of the tread element, wherein the trim piece includes a back surface defining: a first recess for receiving a thick sub-tread for a first type of pre-existing stair structure; and a second recess for receiving a thin sub-tread for a second type of pre-existing stair structure. The capping apparatus is attached (step 1904) to either the first type of pre-existing stair structure or the second type of pre-existing stair structure. The capping apparatus may be attached to the first type of pre-existing stair structure or the second type of pre-existing stair structure using any suitable attachment mechanism, such as, for example, adhesive, nails, and/or screws. In some embodiments, an outer edge (e.g., a bullnose portion) of the stair sub-tread can be sawed or machined off prior to installation of the capping apparatus. In preferred implementations, however, no such sawing or machining of the sub-tread is needed. Additionally or alternatively, installation of the capping apparatus can include attaching a riser board to a front, vertical face of the first type of pre-existing stair structure or the second type of pre-existing stair structure.

Each numerical value presented herein, for example, in a table, a chart, or a graph, is contemplated to represent a minimum value or a maximum value in a range for a corresponding parameter. Accordingly, when added to the claims, the numerical value provides express support for claiming the range, which may lie above or below the numerical value, in accordance with the teachings herein. Absent inclusion in the claims, each numerical value presented herein is not to be considered limiting in any regard.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention.

The features and functions of the various embodiments may be arranged in various combinations and permutations, and all are considered to be within the scope of the disclosed invention. Accordingly, the described embodiments are to be considered in all respects as only illustrative and not restrictive. Furthermore, the configurations, materials, and dimensions described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A rigid capping apparatus for covering a pre-existing stair structure, the apparatus comprising:

a tread element comprising a substantially planar uppermost surface; and a trim piece attached to the tread element proximate a longitudinal edge of the tread element, the trim piece comprising a top edge aligned with the substantially planar uppermost surface of the tread element, wherein the trim piece comprises a back surface defining:

a first recess for receiving a thick sub-tread for a first type of pre-existing stair structure, the first recess having a height greater than or equal to 39 mm; and a second recess for receiving a thin sub-tread for a second type of pre-existing stair structure, the second recess having a height greater than or equal to 25 mm, and wherein at least one of:

(a) the second recess is defined by a top surface and a bottom surface, and the top surface and the bottom surface are substantially parallel, or (b) the trim piece comprises a bullnose portion having a substantially uniform thickness.

2. The apparatus of claim 1, wherein the tread element is adapted to cover the thick sub-tread and the thin sub-tread.

3. The apparatus of claim 1, wherein the back surface is adapted to be hidden after installation of the apparatus.

4. The apparatus of claim 1, wherein the trim piece comprises a front surface comprising the bullnose portion and at least one concave portion.

5. The apparatus of claim 1, wherein the trim piece is attached with adhesive to a groove in the tread element.

6. The apparatus of claim 1, wherein the thick sub-tread has a thickness of about 38 mm.

7. The apparatus of claim 1, wherein the thin sub-tread has a thickness of about 25 mm.

8. The apparatus of claim 1, wherein the first recess is defined by a rectangular notch in the back surface.

9. The apparatus of claim 1, wherein the second recess is defined by a concave radius in the back surface.

10. The apparatus of claim 1, wherein a combination of the first recess and the second recess is P-shaped.

11. The apparatus of claim 1, wherein the capping apparatus comprises a unitary construction.

12. The apparatus of claim 1, wherein the apparatus comprises at least one of a high density fiberboard, a medium density fiberboard, a moisture resistant fiberboard, or wood.

13. The apparatus of claim 1, wherein the second recess is defined by the top surface and the bottom surface, and the top surface and the bottom surface are substantially parallel.

14. The apparatus of claim 1, wherein the trim piece comprises the bullnose portion having the substantially uniform thickness.

15. The apparatus of claim 1, wherein the capping apparatus comprises a total height less than or equal to about 67 mm.

16. The apparatus of claim 1, wherein at least a portion of the trim piece was formed from a trim precursor element.

17. A method of manufacturing a rigid capping apparatus for covering a pre-existing stair structure, the method comprising:

providing a tread element comprising a substantially planar uppermost surface;

machining a groove in a surface of the tread element proximate a longitudinal edge of the tread element;

attaching a cap precursor element to the groove; and machining the tread element and the cap precursor element to form a front surface comprising a convex surface and a back surface defining:

a first recess for receiving a thick sub-tread for a first type of pre-existing stair structure, the first recess having a height greater than or equal to 39 mm; and a second recess for receiving a thin sub-tread for a second type of pre-existing stair structure, the second recess having a height greater than or equal to 25 mm, wherein at least one of:

(a) the second recess is defined by a top surface and a bottom surface, and the top surface and the bottom surface are substantially parallel, or (b) the machined cap precursor element comprises a bullnose portion having a substantially uniform thickness, wherein the machined cap precursor element comprises a top edge aligned with the substantially planar uppermost surface of the tread element.

18. The method of claim 17, wherein the groove extends along an entire width of one side of the longitudinal edge.

19. The method of claim 17, wherein the cap precursor element is sized in at least one dimension to have a width approximately equal to a width of the groove and is sized in at least one other dimension to have a length approximately equal to a length of the groove.

20. A method of installing a rigid capping apparatus to cover a pre-existing stair structure, the method comprising:

providing a capping apparatus comprising:

a tread element comprising a substantially planar uppermost surface; and a trim piece attached to the tread element proximate a longitudinal edge of the tread element, the trim piece comprising a top edge aligned with the substantially planar uppermost surface of the tread element, wherein the trim piece comprises a back surface defining:

a first recess for receiving a thick sub-tread for a first type of pre-existing stair structure, the first recess having a height greater than or equal to 39 mm; and a second recess for receiving a thin sub-tread for a second type of pre-existing stair structure, the second recess having a height greater than or equal to 25 mm, and wherein at least one of:

(a) the second recess is defined by a top surface and a bottom surface, and the top surface and the bottom surface are substantially parallel, or (b) the trim piece comprises a bullnose portion having a substantially uniform thickness; and attaching the capping apparatus to either the first type of pre-existing stair structure or the second type of pre-existing stair structure.

* * * * *